US006331073B1

(12) United States Patent
Chung

(10) Patent No.: US 6,331,073 B1
(45) Date of Patent: Dec. 18, 2001

(54) ORDER-CHANGING MICROFLUIDIC MIXER

(75) Inventor: Yung-Chiang Chung, Chutung, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/692,461

(22) Filed: Oct. 20, 2000

(51) Int. Cl.[7] ..... B01F 13/00
(52) U.S. Cl. ..... 366/341; 366/165.1
(58) Field of Search ..... 366/165.1, 165.4, 366/336, 340, 341, 262, 267, 268, 269, 342

(56) References Cited

U.S. PATENT DOCUMENTS 4,534,659 * 8/1985 Dourdeville et al. ..... 366/338
5,573,334 * 11/1996 Anderson ..... 366/165.1
6,065,864 * 5/2000 Evans et al. .
6,170,981 * 1/2001 Regnier et al. ..... 366/336

* cited by examiner

*Primary Examiner*—Tony G. Soohoo
(74) *Attorney, Agent, or Firm*—Bacon & Thomas

(57) ABSTRACT

An order-changing microfluid mixer comprises an extended microfluidic channel and a chamber structure that provides order-changing functions to microfluid when the microfluid passes through the chanter structure. The order-changing chamber has two openings connected to said microfluidic channel and divides said microfluidic channel into two sections. When a microfluid is driven from one section of the microfluidic channel to the other, the microfluid enters into the order-changing chamber and flows along a first side of the order-changing chamber, whereby portions of the microfluid positioned adjacent to the second side of the order-changing chamber remain unmoved. When a microfluid is driven from the other section of the microfluidic channel to the one section, the microfluid flows along the second side of the order-changing chamber, whereby portions of the microfluid positioned adjacent to the second side of the order-changing chamber are driven to the first terminal of the microfluidic channel, and portions of the microfluid positioned adjacent to the first side of the order-changing chamber stays unmoved. By driving the microfluid back and forth in the microfluidic channel, spatial orders of the microfluid may be changed as desired.

10 Claims, 3 Drawing Sheets

(a)

(b)

ORDER-CHANGING MICROFLUIDIC MIXER

FIELD OF INVENTION

The present invention relates to an order-changing microfluid mixer, especially to a mixer that can change the spatial orders of a microfluid in a microchannel.

BACKGROUND OF INVENTION

A microfluid processing device comprises in general a microchannel, pumps, heaters, coolers and mixers such that a microfluid may be transported and processed inside and along the microchannel. Sometimes when the microfluid is in one section of the microchannel, at one terminal of the section is a heater and at the other terminal of the section is a cooler. Sometimes at one terminal of the section a reactant is added, while at the other terminal a different reactant is added. When a microfluid containing reactants is being processed in the microchannel uniform distributions of temperature and concentration are required. However, because of the large length to cross-sectional area ratio of microchannel it always happens that, when one terminal of a microfluid is being heated, the other terminal of the microfluid is being cooled at the same time. If this problem is not solved, a permanent spatial temperature gradient will exist in the microchannel, such that a uniform temperature distribution may not be obtained. In a microchannel, it also happens that, when a reactant is added into a section of the microfluid, the reactant can not travel to other sections effectively. Such a phenomenon makes it difficult to form a uniform distribution of reactants in the microfluid In order to solve this problem, it is necessary to include a means in the microchannel, such that every part of the microfluid inside the microchannel may access the heaters or coolers directly and that reactants may be added into every part of the microfluid directly. As a result, an order-changing mechanism in the microchannel to change the spatial order of sections of a microfluid is required.

OBJECTIVES OF THE INVENTION

The objective of this invention is to provide an order-changing mixer for microfluid to solve the problem of non-uniform distribution of temperature or reactants in a microfluid in a microchannel.

Another objective of this invention is to provide an order-changing microfluidic mixer that is simple to fabricate in structure, and is easy to prepare and contains no active elements.

Another objective of this invention is to provide a novel order-changing mixer that is able to change the sectional order of a microfluid when the microfluid is transported through the mixer.

SUMMARY OF INVENTION

According to the present invention, an order-changing microfluid mixer is disclosed. The order-changing microfluid mixer comprises an extended microfluidic channel and a chamber structure that provides order-changing functions to microfluid when the microfluid passes through the chamber structure. The order-changing chamber has two openings connected to said microfluidic channel. In the application, a microfluid is driven from a first terminal of the microfluidic channel to a second terminal, the microfluid enters into the order-changing chamber and flows along the first side of the order-changing chamber. At the same time, sections of the microfluid positioned adjacent to the second side of the order-changing chamber stay at said second side of the order-changing chamber. When a microfluid is driven from the second terminal of the microfluidic channel to the first terminal the microfluid flows along the second side of the order-changing chamber. At this time, sections of the microfluid positioned adjacent to the second side of the order-changing chamber are driven to the first terminal of the microfluidic channel. The sections of the microfluid originally positioned at the second terminal of the microfluidic channel enters into the second side of the order-changing chamber, while sections of the microfluid positioned adjacent to the first side of the order-changing chamber stays unmoved. The microfluid is then driven from the first terminal of the microfluidic channel to the second terminal again, whereby sections of the microfluid originally positioned adjacent to the first side of the ordering chamber enters into the second terminal of the microfluidic channel. The microfluid is driven from the second terminal to the first terminal again, whereby sections of the microfluid originally positioned adjacent to the second side of the order-changing chamber enters the first terminal of the microfluidic channel. By repeating the above-said processes, sectional orders of the microfluid may be changed as desired.

The above and other objectives and advantages of this invention may be clearly understood from the detailed description by referring to the following drawings.

DETAILED DESCRIPTION OF THE INVENTION

Figure 1:
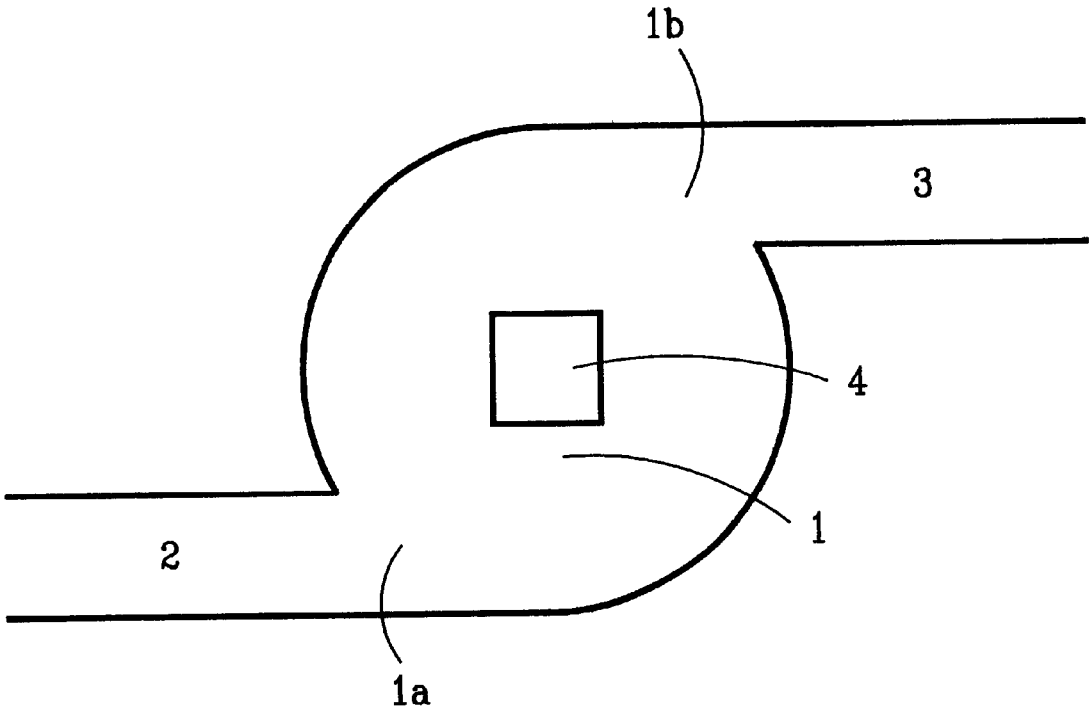
FIG. 1 illustrates the structure of the order-changing microfluidic mixer of this invention.

The following is a detailed description of the order-changing microfluid mixer of this invention. FIG. 1 illustrates the structure of the order-changing microfluidic mixer of this invention.

As shown in FIG. 1, the order-changing microfluid mixer of this invention may be used in a microchannel wherein a microfluid may be transported. The order-changing microfluid mixer of this invention comprises a round or multi-angular chamber 1, with two openings at two opposite sides relating to center of the chamber 1. Openings 1*a* and 1*b* connect to respective sections 2 and 3 of a microfluidic channel. A fluid may be driven into the chamber from the first terminal 2 or the second terminal 3 of the microchannel, filling the chamber 1, and the terminals 2 and 3. With the help of a microfluidic driving mechanism (not shown), the microfluid may travel in the microchannel from one terminal to another, under a predetermined speed.

In the present invention, the microfluid may be filled into and driven in the microchannel with any driving mechanism. In practice, a bi-directional driving pump may be used to transport the microfluid in the microchannel.

The order-changing microfluid mixer of this invention may be prepared with a substrate and a upper cover (not shown), by bonding the upper cover to the substrate prepared with the chamber 1 and the microchannel 2 and 3. In the preparation of the order-changing microfluidic mixer of this invention, a substrate is first prepared. A round chamber whose size is 4 mm in diameter and 0.5 mm in depth is formed. And to grooves with 0.5 mm wide and 0.5 mm deep which connect to the chamber at two symmetric positions at the sidewall of the chamber in relation to the center of the chamber and extend along the tangent of the chamber to two sides of the substrate, are prepared The upper cover is then bonded to the substrate to form microfluidic channels 2 and 3, with a round chamber 1 in a section of the microfluidic channels 2 and 3.

Figure 2:
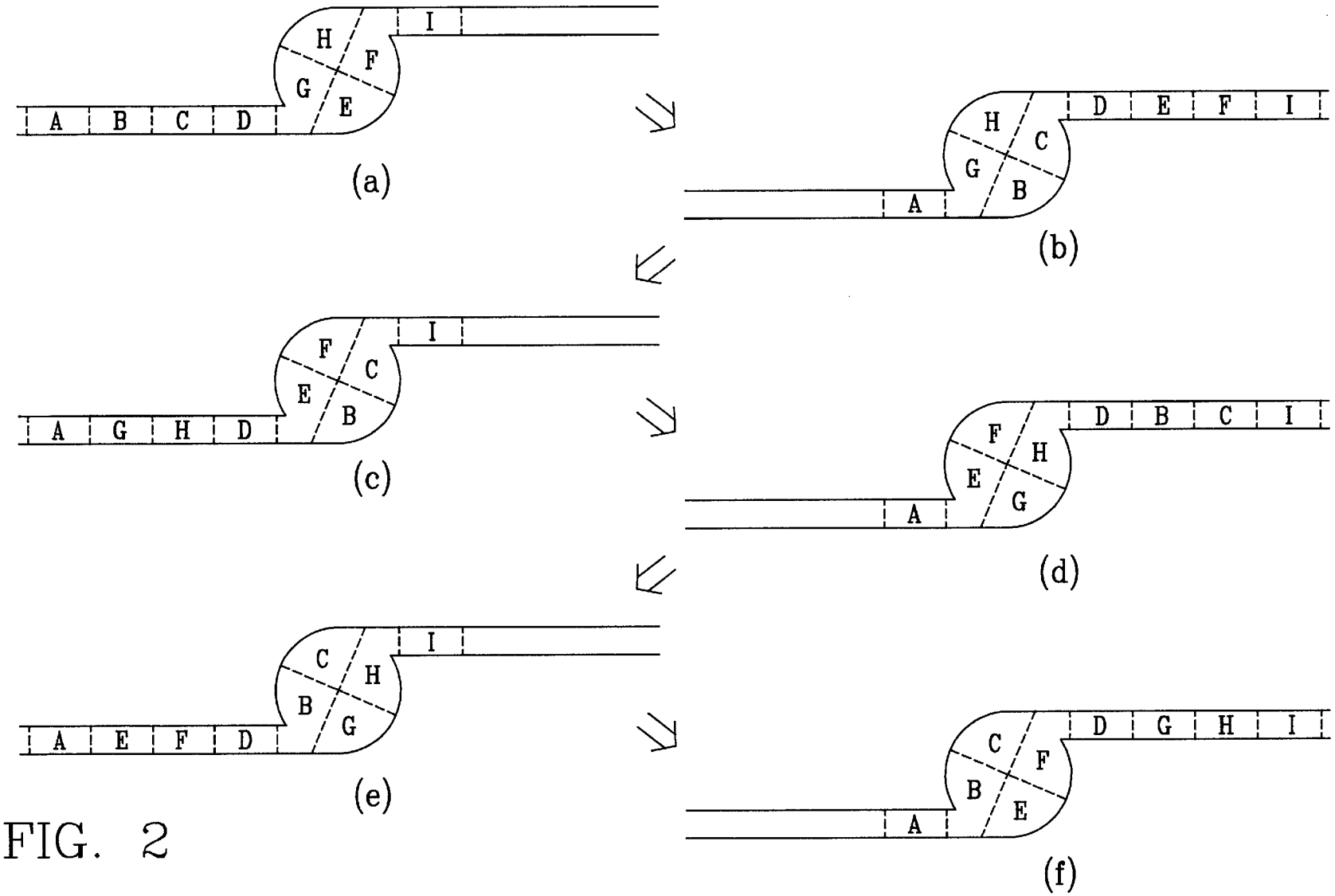
FIG. 2 illustrates the flow chart of the order-changing process of a microfluid in the order-changing microfluidic mixer of this invention.

In the following, a description of the order-changing process of a microfluid in the order-changing microfluidic mixer of this invention will be given. FIG. 2 illustrates the flow chart of the order-changing process of a microfluid in the order-changing microfluidic mixer of this invention.

As shown in this figure, before changing the order of a microfluid, the microfluid is first added into the microchannel to fill up the first terminal 2 of the microfluidic channel and the order-changing chamber 1 and a portion of the second terminal 3 of the microfluidic channel. The result is shown in (a) of FIG. 2. For the convenience of description and illustration, the microfluid inside the chamber 1 and the terminals 2 and 3 are divided into 9 sections, from A to I. In the figure, the dotted lines show the descriptive divisions of the sections A to I.

When the microfluid is driven from the first terminal 2 to the second terminal 3 of the microfluidic channel, among the sections of the microfluid inside the order-changing chamber 1, only sections E and F of the microfluid that are adjacent to the first side of the order-changing chamber 1 is moved to the second terminal 3 and the areas originally occupied by sections E and F are occupied by sections B and C that were originally positioned in the first terminal, while sections G and H that are adjacent to the second side of the order-changing chamber 1 stay unmoved. FIG. 2(*b*) illustrates the result of this step.

The microfluid is then driven from the second terminal 3 to the first terminal 2. At this time, sections G and H adjacent to the second side of the chamber 1 move to the first terminal 2, replaced by sections E and F, while sections B and C remain adjacent to the first side of the chamber 1. FIG. 2(*c*) shows the result of this step.

The microfluid is then driven from the first terminal 2 to the second terminal 3 again. At this time, sections B and C enters the second terminal 3, replaced by sections G and H, while sections E and F remains unmoved. FIG. 2(*d*) shows the result of this step.

The microfluid is then driven from the second terminal 3 to the first terminal 2 again. Thereby, sections E and F adjacent to the first side of the chamber 1 move to the first terminal 2, replaced by sections B and C, while sections G and H remain adjacent to the first side of the chamber 1. The result of this step is shown in (e) of FIG. 2.

After the above said 4 steps, sections E and F that in the very beginning were at the second terminal 3 (see FIG. 2(*b*)) are moved to the first terminal 2 (see FIG. 2, (*e*)) and sections B and C that in the very beginning were at the first terminal 2 (see FIG. 2, (*a*)) are now moved to the second terminal 3 (see FIG. 2(*e*)).

When the volume of sections A and I may be reduced to almost zero with the help of an effective pumping system, it is possible to achieve the result where no sections of the microfluid would always stay at the same area of the microchannel at all times during the processing of the microfluid, whereby any section of the microfluid may be exchanged with other sections of the microfluid.

EMBODIMENT

Figure 3:
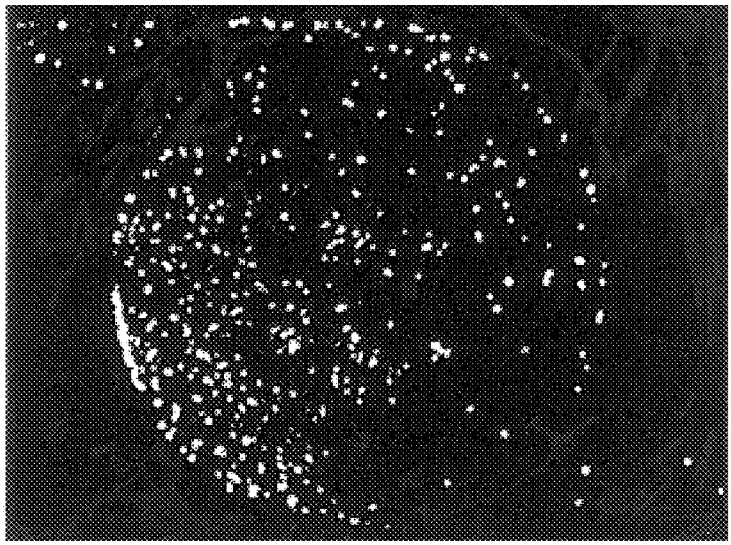
FIGS. 3*a* and 3*b* are two photos showing flows of microfluid in the order-changing chamber of the present invention, when the microfluid is driven different directions.
Figure 3:
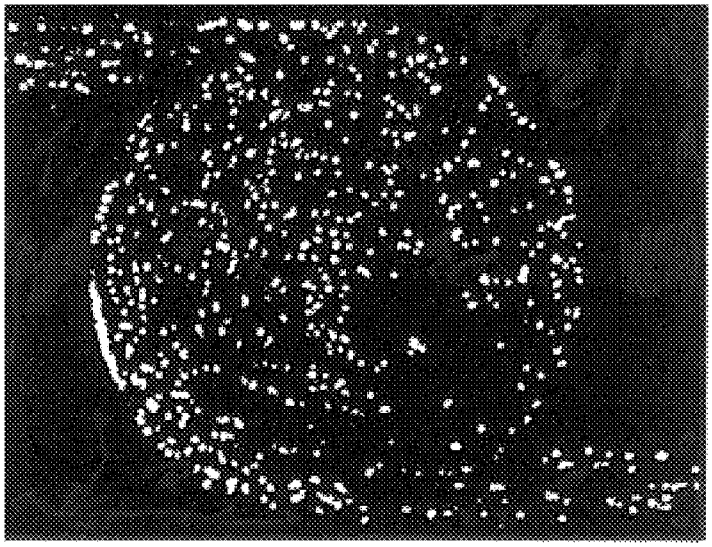

In order to prove the effectiveness of this invention, an order-changing mixer is prepared with a PMMA (polymethyl methacrylate) substrate. The complete micromixer consists of PMMA whose dimension is 50 mm long, 50 mm wide and 15 mm tall. The mixer has one mixing chamber (diameter 4 mm, depth 0.5 mm) and two channels (cross-section 0.5×0.5 mm), and the total volume is about 20 l. The 15 $\mu$m diameter yellow-green polystyrene fluorescent particles were used to trace the flow. The flow field was visualized by a fluorescent stereo microscope. The solution of fluorescent particles is injected slowly to fill the chamber and parts of the channels. The solution was driven back and forth in the fluid channel and the flow field was observed. FIGS. 3*a* and 3*b* are photos showing respectively flows of the solution in the chamber of the mixer, when the microfluid is driven different directions.

EFFECTS OF THE INVENTION

As shown above, the order-changing microfluidic mixer of the present invention is able to change the spatial orders of a microfluid in a microchannel. During the order-changing process, the microfluid is driven back and forth inside the microchannel, whereby the microfluid is stirred in the chamber and, thus, uniform distributions of temperature and concentration in the microfluid may be achieved.

In the above detailed description, an order-changing mixer with a round chamber is taken for example, for illustration purposes. It is however understood that an order-changing chamber with other peripherals, such as ellipse, hexagon, octagon and other shapes may also be suited in this invention.

In the embodiment oft this invention, the two terminals of the microchannel are connected to two sides and extend along the tangential directions of the order-changing chamber, for illustration purposes. It is also understood that other arrangements in positions of junctions and directions of extension may also be used to achieve the same or similar effects.

In the application of this invention, when the microfluid is driven to move along one side of the order-changing chamber, portions of the microfluid adjacent to the other side of the order-changing chamber are stationary. In order to bring up such phenomenon, the flow rate of the microfluid is an important factor. It is thus recommended that a driving mechanism that can drive a microfluid to move inside a microchannel under a controlled speed or a fluid that can satisfy this purpose is used.

In another embodiment of this invention, a pillar (4) at approximately the center of the order-changing chambers provided to achieve the order-changing effect of this invention.

This invention discloses a microchannel structure that provides spatial order-changing effects to microfluid moving in the microchannel. The microchannel structure of this invention has a simplified structure and is easy to prepare. During the order-changing process, the microfluid is thoroughly mixed. Therefore, uniform distributions of temperature and concentration in the microfluid may be easily achieved.

As the present invention has been shown and described with reference to preferred embodiments thereon those skilled in the art will recognize that the above and other changes may be made therein without departing form the spirit and scope of the invention.

What is claimed is:

1. A method to change the spatial order of a microfluid in a micro fluid channel, comprising the following steps: providing an extended micro fluid channel;

providing an order-changing chamber in said micro fluid channel which divides said micro fluid channel into a first and second section, filling a microfluid into said fluid channel and said order-changing chamber; and driving said microfluid to move back and forth in said fluid channel and through said order-changing chamber;

wherein when said microfluid moves through said order-changing chamber from the first section of said microfluid channel to the second section whereby portions of said microfluid positioned adjacent to a side of said order-changing chamber remain unmoved.

2. The method according to claim 1 wherein said fluid driving step comprises sequentially driving said fluid to move from the first section of said microfluid channel toward the second section through said chamber, back from said second section to said first section, from said first section to said second and backward from said second section to said first section.

3. A method to change the spatial order of a microfluid in a micro fluid channel, comprising the following steps: providing an extended micro fluid channel;

providing an order-changing chamber in said micro fluid channel which divides said micro fluid channel into a first and second section, filling a microfluid into said fluid channel and said order-changing chamber; and driving said microfluid to move back and forth in said fluid channel and through said order-changing chamber;

wherein when said microfluid moves through said order-changing chamber from the first section of said microfluid channel to the second section whereby portions of said microfluid positioned adjacent to a side of said order-changing chamber remain unmoved and wherein said order-changing chamber is a round chamber and said micro fluid channel is connected to two opposite sides of said round chamber, with both sections being aligned with respective tangential lines of said round chamber.

4. A order-changing microfluidic mixer comprising:

an extended microfluid channel in which a microfluid may be transported; and an order-changing chamber having first and second side portions, said chamber positioned in said microfluid channel and dividing said microfluid channel into a first and second section, wherein when said microfluid moves through said order-changing chamber having first and second sides from the first section of said microfluid channel to the second section so that portions of said microfluid positioned adjacent to the first side of said order-changing chamber remain unmoved.

5. The order-changing microfluid mixer according to claim 4 wherein said order-changing chamber is a round chamber or an equiangular chamber.

6. The order-changing microfluid mixer according to claim 4 further comprising a pillar provided at approximately center of said order-changing chamber.

7. The order-changing microfluid mixer according to claim 4 wherein said order-changing chamber is a cylindrical chamber or an equiangular chamber.

8. The order-changing microfluid mixer according to claim 7 wherein the cylinder has a diameter of 4 mm and the channels are 0.5 mm wide.

9. The order changing microfluid mixer and two channels according to claim 7 which has a volume of 20 microliters.

10. A order-changing microfluidic mixer comprising:

an extended microfluid channel in which a microfluid may be transported; and an order-changing chamber having first and second side portions, said chamber positioned in said microfluid channel and dividing said microfluid channel into a first and second section, wherein when said microfluid moves through said order-changing chamber having first and second sides from the first section of said microfluid channel to the second section so that portions of said microfluid positioned adjacent to the first side of said order-changing chamber remain unmoved, and wherein said two sections of said microfluid channel are connect to said order-changing chamber at two opposite sides of said order-changing chamber and said sections extend aligned with respective tangential lines of said order-changing chamber.

* * * * *